US006552603B2

(12) United States Patent
Ueda

(10) Patent No.: US 6,552,603 B2
(45) Date of Patent: Apr. 22, 2003

(54) VOLTAGE REFERENCE GENERATION CIRCUIT AND POWER SOURCE INCORPORATING SUCH CIRCUIT

(75) Inventor: Yoshinori Ueda, Sanda (JP)

(73) Assignee: Ricoh Company Ltd. (JP)

( * ) Notice: Subject to any disclaimer, the term of this patent is extended or adjusted under 35 U.S.C. 154(b) by 0 days.

(21) Appl. No.: 09/884,922

(22) Filed: Jun. 21, 2001

(65) Prior Publication Data

US 2002/0036488 A1 Mar. 28, 2002

(30) Foreign Application Priority Data

Jun. 23, 2000 (JP) ..... 2000-189343
Sep. 14, 2000 (JP) ..... 2000-279070

(51) Int. Cl.[7] ..... G05F 3/24
(52) U.S. Cl. ..... 327/541; 327/543; 323/313
(58) Field of Search ..... 327/538, 540, 327/541, 542, 543; 323/312, 313

(56) References Cited

U.S. PATENT DOCUMENTS 4,224,539 A * 9/1980 Musa et al. ..... 327/78
4,318,040 A * 3/1982 Hilbourne ..... 327/437
4,494,219 A * 1/1985 Tanaka et al. ..... 365/185.2
4,654,578 A * 3/1987 Salerno et al. ..... 327/581
6,005,378 A * 12/1999 D'Angelo et al. ..... 323/313
6,144,248 A * 11/2000 Oosugi et al. ..... 327/525
6,198,337 B1 * 3/2001 Matsuura ..... 327/525

FOREIGN PATENT DOCUMENTS

JP 56-108258 8/1981
JP 8-335122 12/1996

* cited by examiner

*Primary Examiner*—Timothy P. Callahan
*Assistant Examiner*—Terry L. Englund
(74) *Attorney, Agent, or Firm*—Dickstein Shapiro Morin & Oshinsky LLP

(57) ABSTRACT

A voltage reference generation circuit is disclosed including a voltage reference generating stage and a voltage reference output stage, in which a depletion-mode MOS transistor and an enhancement-mode MOS transistor are connected in series, and the junction formed between these MOS transistors serves as an output terminal for outputting a voltage to be input to the voltage reference output stage. In the output stage, two enhancement-mode MOS transistors having the same channel dopant profile are connected in series between a power source and the ground, the gate of one MOS transistor is connected to the output terminal of the generating stage, the gate and drain of the other MOS transistor are interconnected, and the junction formed between these MOS transistors serves as an output terminal for a voltage reference. In addition, each of the enhancement-mode MOS transistors is provided with a floating gate having a different threshold voltage depending on, the coupling coefficient between the floating gate and a gate, the amount of charge input to the floating gate, the kind of dielectric material included in the gate, or the thickness of a gate oxide layer, which is suitably utilized to supply reference voltages with improved stability to fluctuations in operating temperatures or processing parameters.

16 Claims, 12 Drawing Sheets

VOLTAGE REFERENCE GENERATION CIRCUIT AND POWER SOURCE INCORPORATING SUCH CIRCUIT

BACKGROUND

1. Field

This patent specification relates to a voltage reference generation circuit comprising MOS or CMOS transistors, and an apparatus incorporating such generation circuit exemplified by a power source, which is suitably in use for relatively small electronic devices such as hand-held cellular phones, for example.

2. Discussion of the Background

As the use of hand-held apparatuses becomes more widespread, numerous efforts have been made to provide reliable power supplies for these apparatuses with appropriate voltage reference generation circuits.

It has been disclosed previously in Japanese Laid-Open Patent Application No. 56-108258 to provide a voltage reference generation circuit including a depletion-mode MOS transistor with its gate and drain interconnected to be utilized as a constant current source. In that disclosure, the gate and the drain of the depletion-mode MOS transistor Q1 are interconnected as shown in FIG. 1, in which a constant current from the MOS transistor is supplied to succeeding transistor circuits.

Namely, each having a gate and a drain interconnected, enhancement-mode MOS transistors Q12 and Q13 are further connected in series to be operated by the constant current supplied by the MOS transistor Q1. Reference voltages are then obtained from the voltages generated by these transistors Q12 and Q13.

Incidentally, the MOS transistors Q1, Q12 and Q13 are all of N-channel type. In addition, the portion of the transistors Q12 and Q13 illustrated in FIG. 1 may be displaced by either a single transistor (FIG. 6) or more than two transistors. Also shown in FIG. 1 are a couple of junctions and values of the potential voltages, $V_0$2 and $V_0$3, at respective junctions.

In the case of the above noted single transistor illustrated in FIG. 6, a reference voltage is obtained as the difference between the threshold voltage $V_t$_d of depletion-mode MOS transistor Q21 and the voltage at $V_t$_e of enhancement-mode MOS transistor Q22.

There is an embodiment in Application 4-65546 regarding to methods for forming MOS transistors Q21 and Q22 (FIG. 6) having different values of threshold voltage, in which the difference is affected by varying the impurity concentration in substrates and/or channel regions of respective transistors, that is achieved by, for example, changing the number of ions in ion implantation process steps.

Although no description is found in that disclosure for utilizing the above noted two transistors Q12 and Q13 (FIG. 1), it is noted that threshold difference in depletion-mode MOS transistor Q1, and enhancement-mode MOS transistors Q12 and Q13, such as described herein below, may similarly be effected by varying impurity concentrations in substrates and/or channel regions.

In addition to the voltage reference generation circuit of FIG. 1, a further voltage reference generation circuit may alternatively be formed as illustrated in FIG. 2, which includes a MOS transistor having its gate and drain interconnected so as to serve as a constant current source.

Referring to FIG. 2, there included in the circuit are the same depletion-mode MOS transistor Q1 as that of FIG. 1, an enhancement-mode MOS transistor Q2 having a low threshold voltage $V_t$l and another enhancement-mode MOS transistor Q3 having a higher threshold voltage $V_t$h. In this construction of the voltage reference generation circuit, a reference voltage is obtained as the difference between these threshold voltages $V_t$h and $V_t$l of the enhancement-mode MOS transistors Q3 and Q2, respectively.

FIG. 3 includes graphical plots of $(I_{ds})^{1/2}$ as a function of $V_{gs}$ for the MOS transistors Q1, Q2 and Q3 at a saturated drain voltage, where $I_{ds}$ is the drain current and $V_{gs}$ is the voltage between gate and source. The conductance factor K is assumed the same for respective transistors.

Since the gate and source of MOS transistor Q1 are interconnected and the value of $V_{gs}$ is therefore zero and fixed, the constant current supplied by Q1 is found to be $I_{constant}$ as shown in FIG. 3. Accordingly, the values of $V_{gs}$ for satisfying the relation $I_{ds}=I_{constant}$ are found to be $V_0$2 and $V_0$3 for the transistors Q2 and Q3, respectively. The reference voltage $V_{REF}$ is subsequently obtained as the difference between these two values;

$$V_{REF} = V_0 3 - V_0 2$$
$$= V_t h - V_t l.$$

The $V_{REF}$ value is therefore obtained as the difference between two thresholds $V_t$h and $V_t$l.

Several advantages may be noted in regard to the generation of the reference voltage $V_{REF}$ with this generation circuit, which follows.

(1) Since the $V_{REF}$ value is obtained as the difference between threshold values, as mentioned above, the dispersion $V_{REF}$ is relatively unaffected by the fluctuation of constant current, which is caused by the dispersion of the threshold voltage of the depletion-mode MOS transistor. As a result, the dispersion of $V_{REF}$ is relatively small.

(2) Because of the approximately same temperature characteristics of the MOS transistors Q2 and Q3, the dependency of $V_{REF}$ value on temperature is relatively small, and (3) since the present circuit may be formed consisting of as few as three MOS transistors, the present circuit can be fabricated with more ease in a smaller area than the bandgap reference circuit.

As is known, this bandgap reference circuit is designed with a PN junction so as to output a relatively small voltage reference $V_{REF}$ having a considerably reduced temperature coefficient, utilizing both its base-emitter voltage $V_{be}$ and thermal voltage $V_t$(=kT/q, where k is Boltzman's constant, T the absolute temperature and q the electron's charge). It may also be added in this context that these voltages $V_{be}$ and $V_t$ have the opposite polarity of temperature dependence to thereby generate compensating resultant voltages, which are appropriately utilized in this circuit.

For the aforementioned single transistor case illustrated in FIG. 6, the relation between threshold voltages and voltage reference from the generation circuit may be considered in a similar manner, which follows.

FIG. 7 includes graphical plots of $(I_{ds})^{1/2}$ as a function of $V_{gs}$ for the aforementioned MOS transistors Q21 and Q22 at a saturated drain voltage, where $I_{ds}$ is the drain current and $V_{gs}$ is the voltage between gate and source. The conductance factor K is assumed same for respective transistors.

Since the gate and source of MOS transistor Q21 are interconnected and $V_{gs}$ is therefore zero and fixed, the constant current supplied by Q21 is found to be $I_{constant}$ as shown in FIG. 7. Accordingly, the $V_{gs}$ value of the transistor Q22 for satisfying the relation $I_{ds}=I_{constant}$ is found as to be $V_{REF}$, $$V_{REF}=V_t_e-V_t_d.$$

As a result, the $V_{REF}$ value is given as the difference between two threshold voltages $V_t$_e and $V_t$_d.

Several advantages can also be noted in regard to the reference voltage generation with the present circuit, which follows. (1) Because of the approximately same temperature characteristics of the MOS transistors Q21 and Q22, the dependency of $V_{REF}$ value on temperature is relatively small, and (2) since the present circuit may be formed consisting of as few as two MOS transistors, the present circuit can be fabricated with more ease in a smaller area than the aforementioned bandgap reference circuit.

In addition, the present circuit can offer another advantage. Namely, after a slight modification thereof, exemplified by a wire connection change of the gate of MOS transistor Q21, another voltage reference generation circuit can be formed, which is capable of supplying relatively small reference voltages (Japanese Laid-Open Patent Application No. 8-335122). The thus formed generation circuit is illustrated in FIG. 8, in which the gate of MOS transistor Q21 is grounded, indicating the difference from the FIG. 6 circuit after the modification.

The above noted capability of this circuit for generating small reference voltages is explained as follows.

There assumed for the depletion-mode MOS transistor Q21 are a threshold voltage $V_t$_d, drain current $I_{ds}$_d and source-gate voltage $V_{gs}$_d. Also assumed for the enhancement-mode MOS transistor Q22 are a threshold voltage $V_t$_e, drain current $I_{ds}$_e and source-gate voltage $V_{gs}$_e. In addition, the conductance factor K is assumed the same for the both transistors.

The drain currents $I_{ds}$_d and $I_{ds}$_e for the MOS transistors Q21 and Q22, respectively, are given as follows, $$I_{ds}_d=K(V_{gs}_d-V_t_d)^2,$$

and $$I_{ds}_e=K(V_{gs}_e-V_t_e)^2.$$

Accordingly, after the relations $$I_{ds}_d=I_{ds}_e \text{ and } V_{gs}_d=-V_{gs}_e,$$

a constant gate-source voltage $V_{gs}$_e is obtained as $$K(-V_{gs}_e-V_t_d)^2=K(V_{gs}_e-V_t_e)^2$$

$$V_{gs}_e=(V_t_e-V_t_d)/2.$$

The $V_{REF}$ value is therefore given as $V_{REF}=(V_t_e-V_t_d)/2$, which is appropriately utilized for generating relatively low reference voltages.

In order to achieve higher accuracy in reference voltages $V_{REF}$, however, the aforementioned generation circuits have several drawbacks, which follows.

For the two transistor construction shown in FIG. 2:

(1) Since threshold voltages $V_{th}$ of respective transistors are determined by ion implantation process carried out individually for each transistor, dispersion in $V_{th}$ is effected independently each other and this may result large dispersion of the difference in $V_{th}$ values and hence in $V_{REF}$. FIG. 4 includes graphical plots of $(I_{ds})^{1/2}$ versus $V_{gs}$ for the transistors Q2 and Q3 affected by the dispersion, in which $V_{th}$ is shifted to a lower value for the former transistor, while to a higher value for the latter, for example. Two dashed straight lines also included in FIG. 4 indicate the plots without the dispersion.

(2) Since the channel profile is different for respective transistors, the temperature dependence of threshold voltage and mobility is not strictly same each other. The improvement of temperature characteristics is therefore rather limited. FIG. 5 includes graphical plots of $(I_{ds})^{1/2}$ versus $V_{gs}$ for the transistors Q2 and Q3 at higher temperatures, in which $V_{th}$ is shifted differently for respective transistors. This is resulted from the change in slope due to the aforementioned difference in channel profile, among others. Two dashed straight lines also included in FIG. 5 show the plots prior to the increase in the temperature.

For the single transistor structure of FIGS. 6 and 8:

(1) In a manner similar to the two transistor structure mentioned earlier, since threshold voltages $V_t$_d and $V_t$_e of the transistors Q21 and Q22, respectively, are determined by ion implantation process carried out individually for each transistor, the dispersion in $V_{th}$ is effected independently each other and this may result a large dispersion of the difference in $V_{th}$ values and hence in $V_{REF}$. FIG. 9 includes graphical plots of $(I_{ds})^{1/2}$ versus $V_{gs}$ for the transistors Q21 and Q22 affected by the dispersion, in which $V_t$_e is shifted higher for the transistor Q22. A dashed straight line also included in FIG. 9 shows the plot without the dispersion.

(2) Since the conductivity type of implanted ions is different for respective transistors Q21 and Q22, the temperature dependence of threshold voltage and mobility is not strictly same each other. The improvement of temperature characteristics is therefore rather limited. FIG. 10 includes graphical plots of $(I_{ds})^{1/2}$ versus $V_{gs}$ for the transistors Q21 and Q22 at higher temperatures, in which $V_t$_e for the transistor Q22 is shifted, that is caused by its slope change due to the aforementioned difference in conductivity type, among others.

(3) In addition, since there exists a limitation in the range of $V_t$_d value for the depletion-mode MOS transistor in the aforementioned modified voltage reference generation circuit of FIG. 8 (the Application No. 8-335122), a relatively large margin in device fabrication has to be allocated for the temperature change and the fluctuation of process parameters. In the voltage reference generation circuit shown in FIG. 6 (22), since the limitation in the range of $V_t$_d value is expressed by the relation $|V_t_d|>V_{REF}>V_t_e$, the $V_t$_d value of the depletion-mode MOS transistor has to be adjusted smaller than that of the FIG. 2 circuit so as to satisfy the above relationship.

Accordingly, it is an object of the present disclosure to provide a voltage reference generation circuit and an apparatus incorporating such generation circuit having most, if not all, of the advantages and features of similar employed circuits and apparatuses, while eliminating many of the aforementioned disadvantages.

It is another object of the present disclosure to provide a voltage reference generation circuit capable of generating reference voltages that are stable to the change in the temperature and unaffected by the fluctuation of process parameters during fabrication steps. The reference voltages may be small enough depending the way of use.

The following brief description is a synopsis of only selected features and attributes of the present disclosure. A more complete description thereof is found below in the section entitled "Description of the Preferred Embodiments"

The voltage reference generation circuit of the present invention includes a depletion-mode MOS transistor configured to serve as a constant current source by having its gate and drain interconnected. At least two enhancement-mode MOS transistors are connected in series to the depletion-mode MOS transistor and configured to operate at a saturated drain voltage by the current supplied by the depletion-mode MOS transistor. The junction of the enhancement-mode MOS transistors and another junction of the depletion-mode MOS transistor and enhancement-mode MOS transistors are configured to serve as output terminals. The enhancement-mode MOS transistors have the same channel dopant profile and different threshold voltages.

The at least two enhancement-mode MOS transistors include two transistors having their gates interconnected, and the junction of these two MOS transistors serves as one of the output terminals. The gate and drain of each of the enhancement-mode MOS transistors are interconnected.

In addition, each of the enhancement-mode MOS transistors is provided with a floating gate to have a different threshold voltage depending on the coupling coefficient between the floating gate and the control gate, the amount of charge input to the floating gate, the kind of dielectric material included in the gate, and the thickness of a gate oxide layer included also in the gate.

According to another aspect, a voltage reference generation circuit disclosed herein includes a voltage reference generating stage and a voltage reference output stage, in which at least two enhancement-mode MOS transistors having the same channel dopant profile are connected in series between a power source and the ground, a gate of one of the enhancement-mode MOS transistors is connected to an output terminal of the voltage reference generating stage, a gate and a drain of the enhancement-mode MOS transistors other than the one are interconnected, and a junction formed between the enhancement-mode MOS transistors other than the one serves as an output terminal for a voltage reference.

In addition, each of the enhancement-mode MOS transistors may consist of a group of paired transistors formed in the common-centroid structure. Further, each of the enhancement-mode MOS transistors has the same beta value, and is formed so as to satisfy the following relation $$T_{OX}/(LW)^{1/2} \leqq 1.5\times10^{-3},$$

where L is the channel length, W the channel width and $T_{OX}$ the gate thickness.

According to still another aspect, a power source is provided, including a voltage reference generation circuit and a detection circuit configured to compare a supplied voltage to the reference voltage generated by the voltage reference generation circuit, in which the voltage reference generation circuit is selected from those generation circuit embodied herein above.

The present disclosure and features and advantages thereof will be more readily apparent from the following detailed description and appended claims when taken with drawings.

DESCRIPTION OF THE PREFERRED EMBODIMENTS

In the detailed description which follows, specific embodiments of the circuit and system are described, which are particularly useful for voltage reference generation in use for voltage and power sources. It is understood, however, that the present disclosure is not limited to these embodiments. For example, the use of voltage reference generation circuit disclosed herein may also be adaptable to any form of electronic circuits and systems. Other embodiments will be apparent to those skilled in the art upon reading the following description.

A plurality of embodiments of voltage reference generation circuits and a power circuit incorporating such generation circuit are detailed in the following Examples 1 through 4 with the emphasis primarily on the channel profile of MOS transistors; while in later Examples 5 through 12, further embodiments are described with the emphasis on the structure of the generation circuits.

Figure 1:
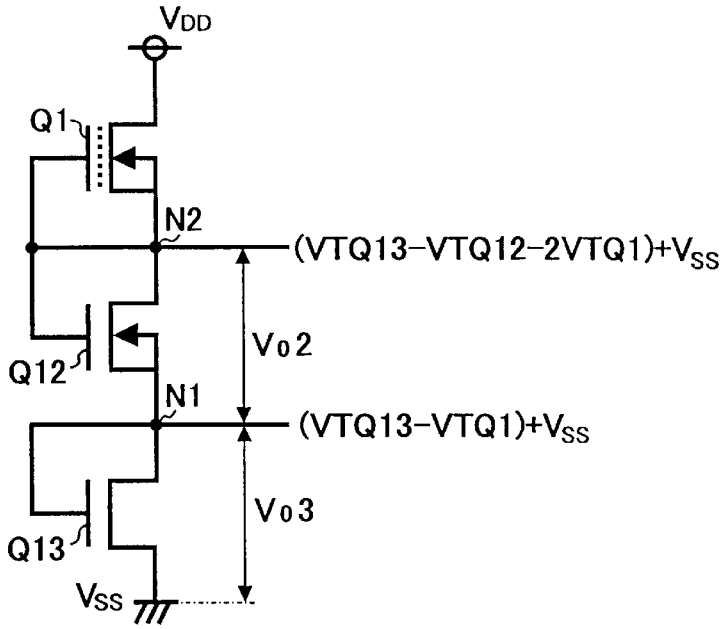
FIG. 1 PRIOR ART
FIG. 1 is an electrical schematic diagram illustrating the principal portion of a previously known voltage reference generation circuit.
Figure 2:
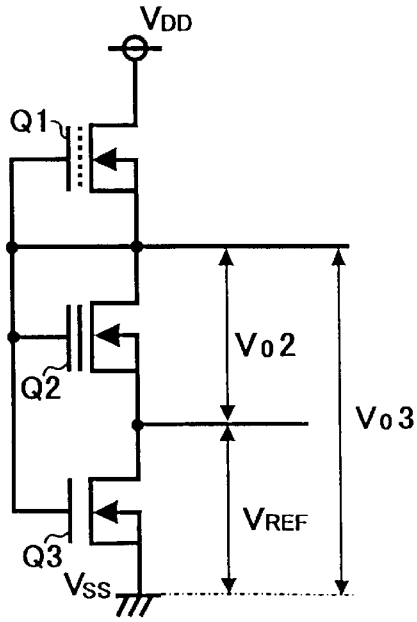
FIG. 2 is an electrical schematic diagram illustrating the principal portion of a voltage reference generation circuit incorporating a plurality of MOS transistors according to one embodiment disclosed herein.
Figure 3:
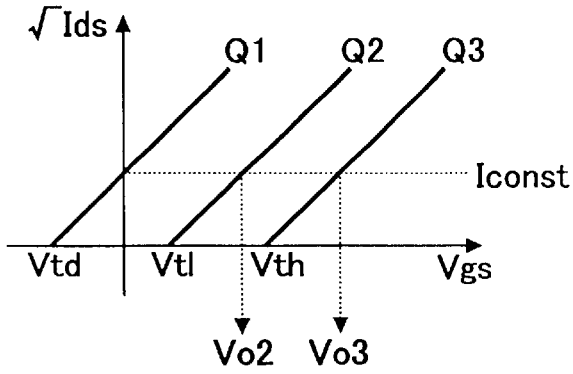
FIG. 3 includes graphical plots of $(I_{ds})^{1/2}$ as a function of $V_{gs}$ for the MOS transistors incorporated into the voltage reference generation circuit of FIG. 2.
Figure 4:
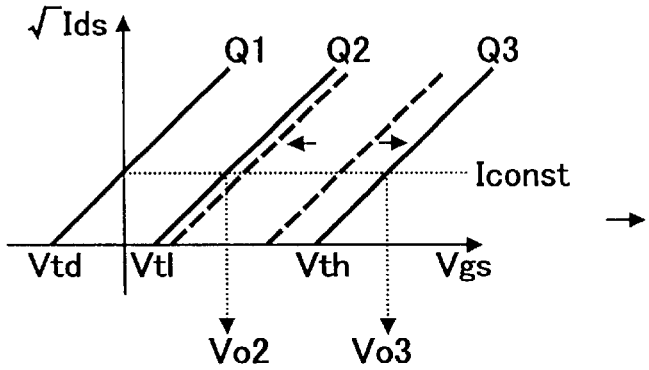
FIG. 4 includes graphical plots of $(I_{ds})^{1/2}$ as a function of $V_{gs}$, affected by the dispersion caused by ion implantation, for the MOS transistors in the voltage reference generation circuit of FIG. 2.
Figure 5:
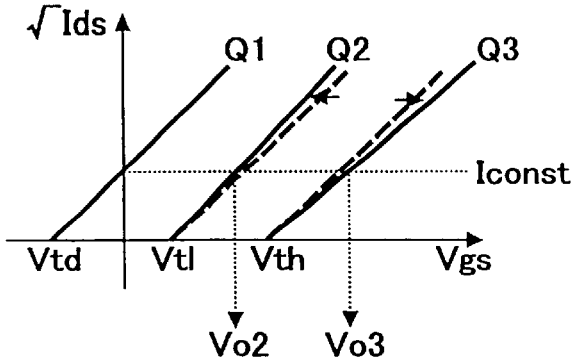
FIG. 5 includes graphical plots of $(I_{ds})^{1/2}$ as a function of $V_{gs}$ at an elevated temperature for the MOS transistors in the voltage reference generation circuit of FIG. 2.
Figure 6:
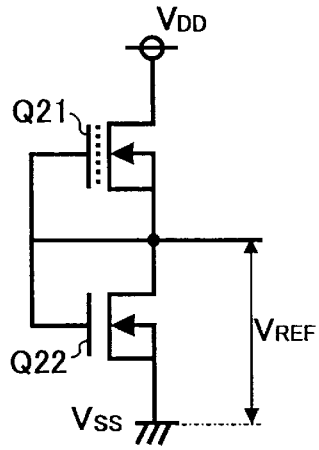
FIG. 6 PRIOR ART
FIG. 6 is an electrical schematic diagram illustrating the principal portion of a further voltage reference generation circuit previously known.
Figure 7:
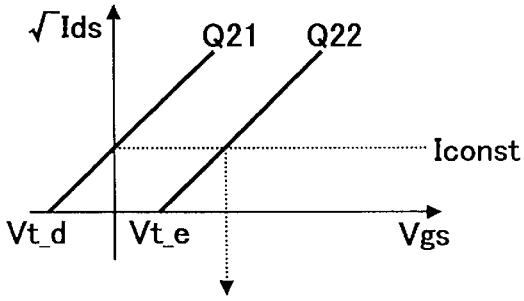
FIG. 7 PRIOR ART
FIG. 7 includes graphical plots of $(I_{ds})^{1/2}$ as a function of $V_{gs}$ for the MOS transistors incorporated into the voltage reference generation circuit of FIG. 6.
Figure 8:
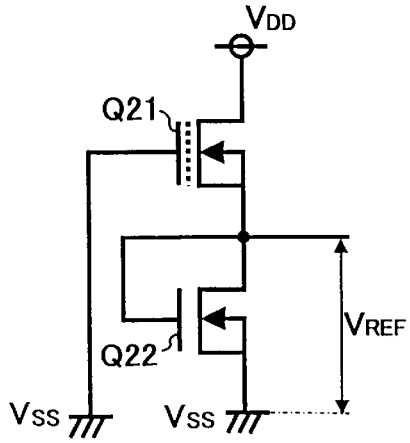
FIG. 8 PRIOR ART
FIG. 8 is an electrical schematic diagram illustrating the principal portion of a further voltage reference generation circuit previously known, which is the modification of the voltage reference generation circuit of FIG. 6.
Figure 9:
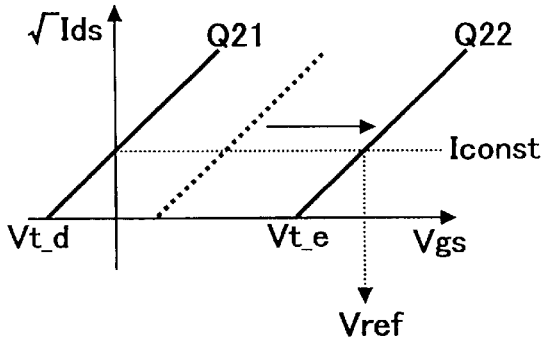
FIG. 9 PRIOR ART
FIG. 9 includes graphical plots of $(I_{ds})^{1/2}$ as a function of $V_{gs}$, affected by the dispersion caused by ion implantation, for the MOS transistors in the voltage reference generation circuit of FIG. 6.
Figure 10:
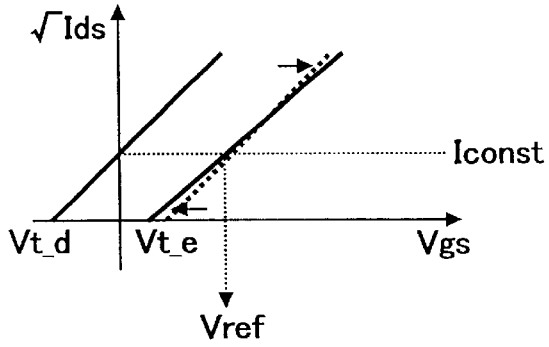
FIG. 10 PRIOR ART
FIG. 10 includes graphical plots of $(I_{ds})^{1/2}$ as a function of $V_{gs}$ at an elevated temperature for the MOS transistors in the voltage reference generation circuit of FIG. 6.

In Examples 1 through 4, voltage reference generation circuits are referred to those illustrated either in FIG. 1 or 2, or the modification thereof.

Namely, two enhancement-mode MOS transistors among the above noted plurality of transistors may have their gates interconnected and the junction of these two MOS transistors serves as one of the output terminals (FIG. 2). Alternatively, the gate and drain of each of the enhancement-mode MOS transistors may be interconnected (FIG. 1). In the FIG. 1 structure, the number of enhancement-mode MOS transistors such as Q12 and Q13, for example, may be equal to, or larger than 3, which are connected in series.

Although there also disclosed in the Application No. 56-108258 a voltage reference generation circuit consisting of a plurality of N-channel MOS transistors, the circuit construction disclosed herein below is unique because of the aforementioned different threshold voltage values in enhancement-mode MOS transistors.

Further, there may be embodied several structures for forming enhancement-mode MOS transistors, which follows.

First, each of the enhancement-mode MOS transistors is provided with a floating gate having a different threshold voltage depending on a coupling coefficient between the floating gate and a gate. Second, each of the enhancement-mode MOS transistors is again provided with a floating gate to be adjusted to have a different threshold voltage depending on the amount of charge input to the floating gate. Third, each of the enhancement-mode MOS transistors is adjusted to have a different threshold voltage depending either the kind of dielectric material, or the thickness of a gate oxide layer, included in the gate.

As indicated earlier, voltage reference generation circuits in the following Examples 1 through 4 are referred to those illustrated either in FIG. 1 or 2, or the modification thereof.

Figure 11:
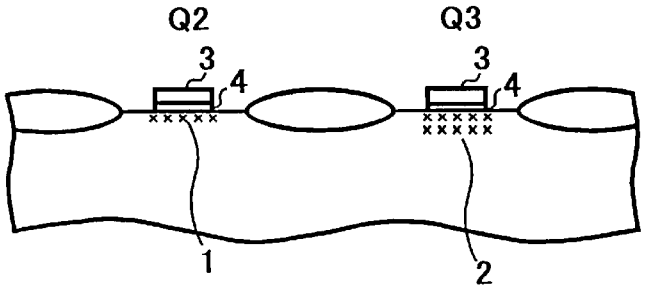
FIG. 11 PRIOR ART
FIG. 11 is a cross-sectional view illustrating two N-channel MOS transistors incorporated into a previously known voltage reference generation circuit.

FIG. 11 shows for comparison a cross-sectional view of two N-channel MOS transistors Q2 and Q3 incorporated into a previously known voltage reference generation circuit, each having a different value of threshold voltage $V_{th}$. These MOS transistors are designated by the similar numerals to those in FIG. 2, in which the transistor Q3 has a higher threshold voltage $V_{th}$ than that of Q2. In addition, these transistors are shown at the process step right after the completion of polysilicon gate formation.

Referring again to FIG. 11, there shown for respective MOS transistors are channel regions 1 and 2 doped with boron ions designated by '×', polysilicon gates 3 and gate oxide layers 4. As shown in FIG. 11, the number of boron ions doped into the transistor Q3 is made larger than that of Q2 so as to increase its threshold voltage $V_{th}$ over that of transistor Q2. Since the profile of the boron dopants in the channel region changes with the number of boron ions, this results in the aforementioned dispersion or processing irregularity, or inappropriate temperature dependence of the device characteristics.

EXAMPLE 1

Figure 12A:
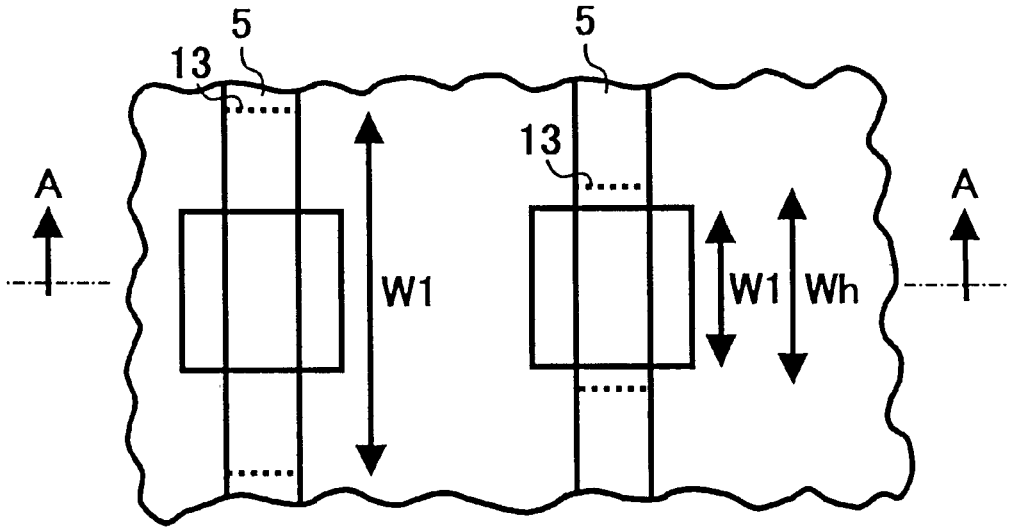
FIG. 12A is a top plan view illustrating N-channel MOS transistors incorporated into a voltage reference generation circuit according to one embodiment disclosed herein.
Figure 12B:
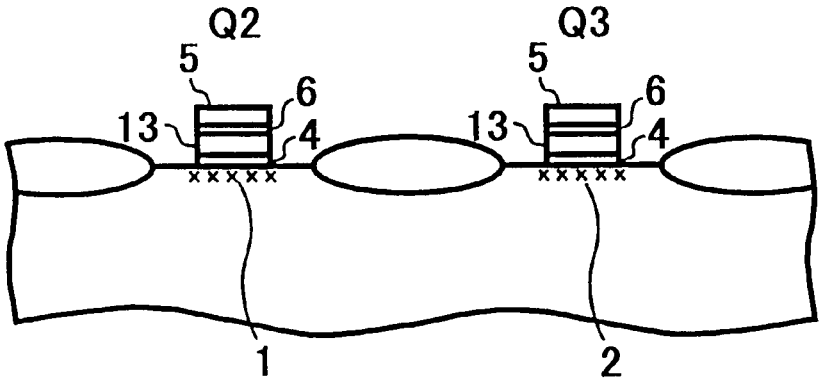
FIG. 12B is a cross-sectional view of N-channel MOS transistors of FIG. 12A, along the line A—A.

FIGS. 12A and 12B are views illustrating MOS transistors incorporated into a voltage reference generation circuit according to one embodiment disclosed herein, in which FIG. 12A is a top plan view thereof and FIG. 12B is a cross-sectional view of FIG. 12A along the line A—A.

While the numerals 1 through 4 in FIG. 12B designate the same portions as those in FIG. 11, the channel doped regions 1 and 2 herein are formed simultaneously so as to have the same dopant profile, that is in contrast to the different profile shown in FIG. 11.

The MOS transistors each include a control gate 5 of polysilicon, which is formed over a floating gate 13 having an underlying inter-poly layer 6. The width of floating gates 13 are Wl and Wh for the low threshold voltage $V_{th}$ MOS transistor Q2 and the high $V_{th}$ transistor Q3 (Wh<Wl), respectively. Coupling coefficients CCh and CCl are defined as the ratio of the length of floating gate to the width of the gate of MOS transistor W for the respective transistors Q3 and Q2, as follows.

$$CCh=Wh/W,$$

and $$CCl=Wl/W.$$

Since the difference in threshold voltage $V_{th}$ between the transistors Q2 and Q3 is known to be effected by the coupling coefficients CCh and CCl, this difference remains constant even when a certain amount of fluctuation is present in channel doping profile, or in the thickness of gate oxide or poly/poly (or inter-poly) layer.

Specific numerical values are given herein below with respect to the structure such as gate oxide thickness=15 nm, inter-poly layer thickness=50 nm, CCh=Wh/W=10 $\mu$m/10 $\mu$m and CCl=Wl/W=20 $\mu$m/10 $\mu$m.

In addition, it is assumed that the Q2 transistor has a $V_{th}$ value of 0.6 V and that the present double-layered polysilicon gate MOS transistor is equivalent to a MOS transistor having a single polysilicon layer structure with its effective capacitance $C_{OX}$ eff, which additionally includes an underlying gate and overlying poly/poly layer having capacitance values of $C_{gate}$ and $C_{psps}$, respectively.

Further assuming $$V_{th} = V_{fb} + 2\phi f + Qb/C_{OX}eff$$
$$\cong 0.3 + Qb/C_{OX}eff,$$

there obtained is $$Qb/C_{OX}eff = 0.3\ \text{V}, \quad \text{and}$$
$$1/C_{OX}eff = 1/C_{gate} + 1/C_{psps}$$
$$= d_{gate}/\varepsilon + d_{psps}/\varepsilon\ (\square C = \varepsilon/d)$$
$$= (d_{gate} + d_{psps})/\varepsilon,$$

where $d_{gate}$ and $d_{psps}$ are the thickness of gate oxide 4 and inter-poly layer 6, respectively, and ∈ is the dielectric constant of silicon oxide layer. The capacitance C is defined in general as $$C = A\square\varepsilon/d$$
$$= W\square L\square\varepsilon/d,$$

where A is the area of a capacitor which contains a dielectric with a dielectric constant ∈, thickness d, width W and length L.

In addition, since the reciprocal of the ratio of coupling coefficients CCh/CCl is equal to the ratio of the inter-poly layer thickness values; and further, in case where the gate widths are equal to each other for two transistors, this reciprocal result is found to be equal to the ratio of widths of the inter-poly layers Wh/Wl, $$CCh/CCl = Wh/Wl$$
$$= 10/20$$
$$= 0.5.$$

It is obtained therefore that the coupling coefficient CCh corresponds to an equivalent layer thickness twice as large as that for the coefficient CCl for the unit area.

Accordingly, $$Qb/C_{OX}eff\ Q2 = Qb \times (15\ \text{nm} + 50\ \text{nm})/\varepsilon$$
$$= 0.3\ \text{V}$$
$$Qb/C_{OX}eff\ Q3 = Qb \times (15\ \text{nm} + 100\ \text{nm})/\varepsilon$$
$$= 0.53\ \text{V}.$$

As a result, the difference in the voltage between these two is obtained as 0.23 V, that is output as a reference voltage $V_{ref}$.

The channel widths W need to be varied in practice for respective MOS transistors Q2 and Q3 to properly adjust the conductive factors for the circuit. However, since the above steps of $V_{REF}$ derivation is carried out through the ratio of coupling coefficients CCh/CCl, $V_{REF}$ values are not affected by the width change. As a result, the constant output of the reference voltage can be obtained in spite of possible fluctuation in the amount of dopants and/or the thickness of the oxide layer.

Among possible causes of the fluctuation, one from etching steps may be considered, which affects the coupling coefficient values. However, this effect from the etching appears relatively small for the following reason.

The MOS transistors for use in voltage reference generation are relatively large in size, because of their large electric power consumption, as exemplified by the relation of W/L= 20 μm/50 μm. This facilitates to alleviate conceivable size fluctuation otherwise caused during the etching steps.

The aforementioned temperature dependence can be reduced as in the case of the present embodiment, by utilizing two MOS transistors which are fabricated so as to be identical in channel profile and temperature dependence of carrier mobility and threshold voltage $V_{th}$. As a result, reduced temperature dependence of the reference voltage $V_{ref}$ can be achieved with the circuit construction disclosed herein over previously known circuits.

Further, several additional advantages are noted as follows.

Since the threshold voltage $V_{th}$ changes with the coupling coefficient CC, $V_{th}$ values are obtained as desired by a circuit designer, and optimum reference voltage $V_{ref}$ values are therefore adjusted at will by appropriately modifying the circuit design alone. In addition, the threshold voltages $V_{th}$ in the two MOS transistors of FIGS. 12A and 12B can also be adjusted to be different each other. This is achieved by fabricating these transistors to be identical in their patterns (including the floating gate width) and also by varying the amount of charge input to (or written into) the floating gate.

As a result, even without either the change in the transistor pattern or corrections of conduction factor, a voltage reference generation circuit can be provided, which is capable of achieving desirable values of the voltage reference.

Incidentally, there is noted herein the relation between the amount of charge Qc to be input for writing and the increment of threshold voltage $\Delta V_{th}$. Namely, the relation is obtained as $$\Delta V_{th} = Qc/C_{ox},$$

where $C_{ox}$ is gate capacitance. When twice as much charge Qc is input, threshold voltage $\Delta V_{th}$ is therefore increased by a factor of two.

EXAMPLE 2

Figure 13:
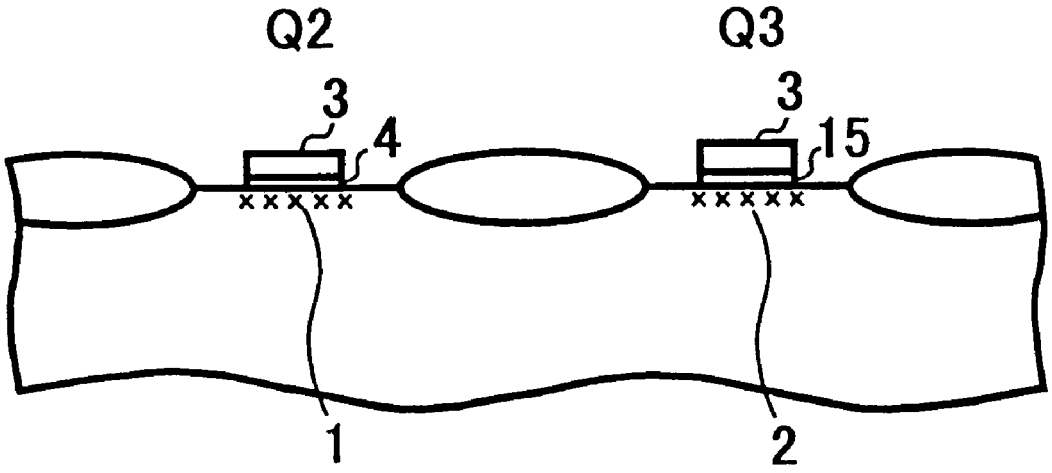
FIG. 13 is a cross-sectional view of N-channel MOS transistors incorporated into a voltage reference generation circuit according to another embodiment disclosed herein.

FIG. 13 is a cross-sectional view illustrating MOS transistors incorporated into a voltage reference generation circuit according to another embodiment disclosed herein.

While the numerals 1 through 4 designate the same portion as those in FIG. 11, gate dielectric layer 15 of transistor Q3 is of nitrides or oxides having a different dielectric constant from that of oxide layer 4 of Q2. These nitrides and oxides are formed by CVD method for example.

The difference in threshold voltage $V_{th}$ is effected in principle in a similar manner to Example 1, with the exception that a single layer of polysilicon is utilized as the present gate dielectric in contrast to the case in Example 1, in which the difference is effected by changing the ratio of the area of the inter-poly double layer.

Namely, the change in capacitance C is achieved by changing dielectric constant ∈ as expressed by the relation $$C = A\square\varepsilon/d$$
$$= W\square L\square\varepsilon/d,$$

so as to obtain different threshold voltages $V_{th}$. In addition, since the increment in threshold voltage $\Delta V_{th}$ is related to the dielectric constant ∈ as $$\varepsilon 1 : \varepsilon 2 = C_{ox}1 : C_{ox}2$$

$$= \Delta V_{th}2 : \Delta V_{th}1.$$

The ratio of threshold voltages $\Delta V_{th}$ is thus obtained as the reciprocal of that of dielectric constants $\in$.

EXAMPLE 3

Figure 14:
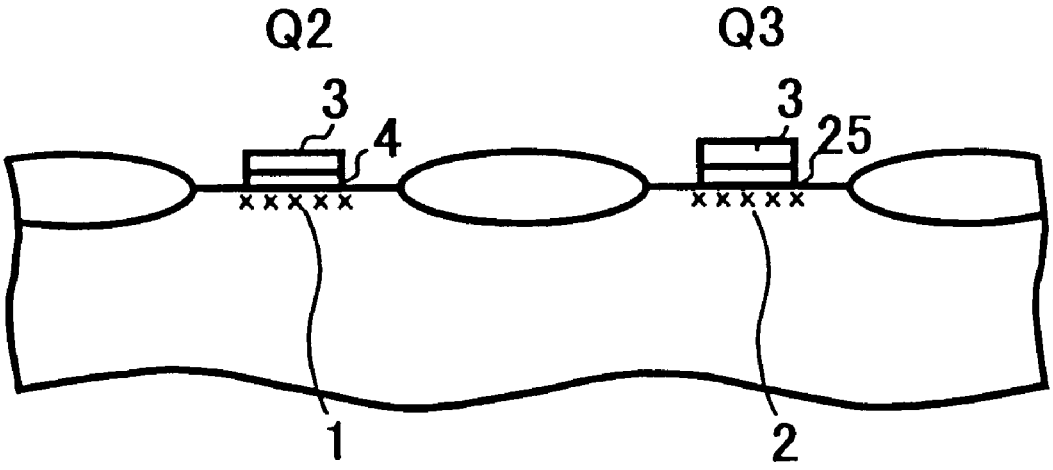
FIG. 14 is a cross-sectional view of N-channel MOS transistors incorporated into a voltage reference generation circuit according to still another embodiment disclosed herein.

FIG. 14 is a cross-sectional view illustrating MOS transistors incorporated into a voltage reference generation circuit according to still another embodiment disclosed herein. While the numerals 1 through 4 designate the same portions as those in FIG. 11, gate dielectric layer 25 of transistor Q3 is formed of oxides having a different layer thickness from that of oxide layer 4 of Q2.

The difference in threshold voltage $V_{th}$ is achieved herein by changing the layer thickness of the oxide. Namely, the increment in threshold voltage $\Delta V_{th}$ is related to the oxide layer thickness $T_{ox}$ by the relation $$T_{ox}1 : T_{ox}2 = C_{ox}2 : C_{ox}1$$

$$= \Delta V_{th}1 : \Delta V_{th}2.$$

The ratio of threshold voltages $\Delta V_{th}$ is thus obtained as that of oxide layer thickness $T_{ox}$.

It is noted herein, referring to FIG. 14, that one of the methods for forming oxide layers each having different thickness is carried out by first forming an oxide layer over the entire surface of the structure, removing the oxide layer over the surface portion appropriated to, for example, the MOS transistor Q2 by known photolithography and etching techniques, and subsequently forming another oxide layer 4 having a proper thickness.

Alternatively, the different oxide layer thickness is achieved by first forming through oxidation steps an oxide layer to the thickness suitable for the oxide layer 25 of the MOS transistor Q3 over the entire surface of the structure, and subsequently removing the oxide layer over the surface portion appropriated to the MOS transistor Q2 to the point of the thickness suitable for the oxide layer 4 of MOS transistor Q2 by again known photolithography and etching techniques.

EXAMPLE 4

A power supply is fabricated incorporating the voltage reference generation circuits disclosed earlier in Examples 1 through 3.

The power supply includes a detection circuit, and is designed primarily for use in hand-held apparatuses such as cellular phones, for example. This detection circuit is configured to compare a supplied voltage $V_{DD}$ to a reference voltage $V_{REF}$ so that either the increase or decrease is detected with respect to the reference voltage.

Figure 15:
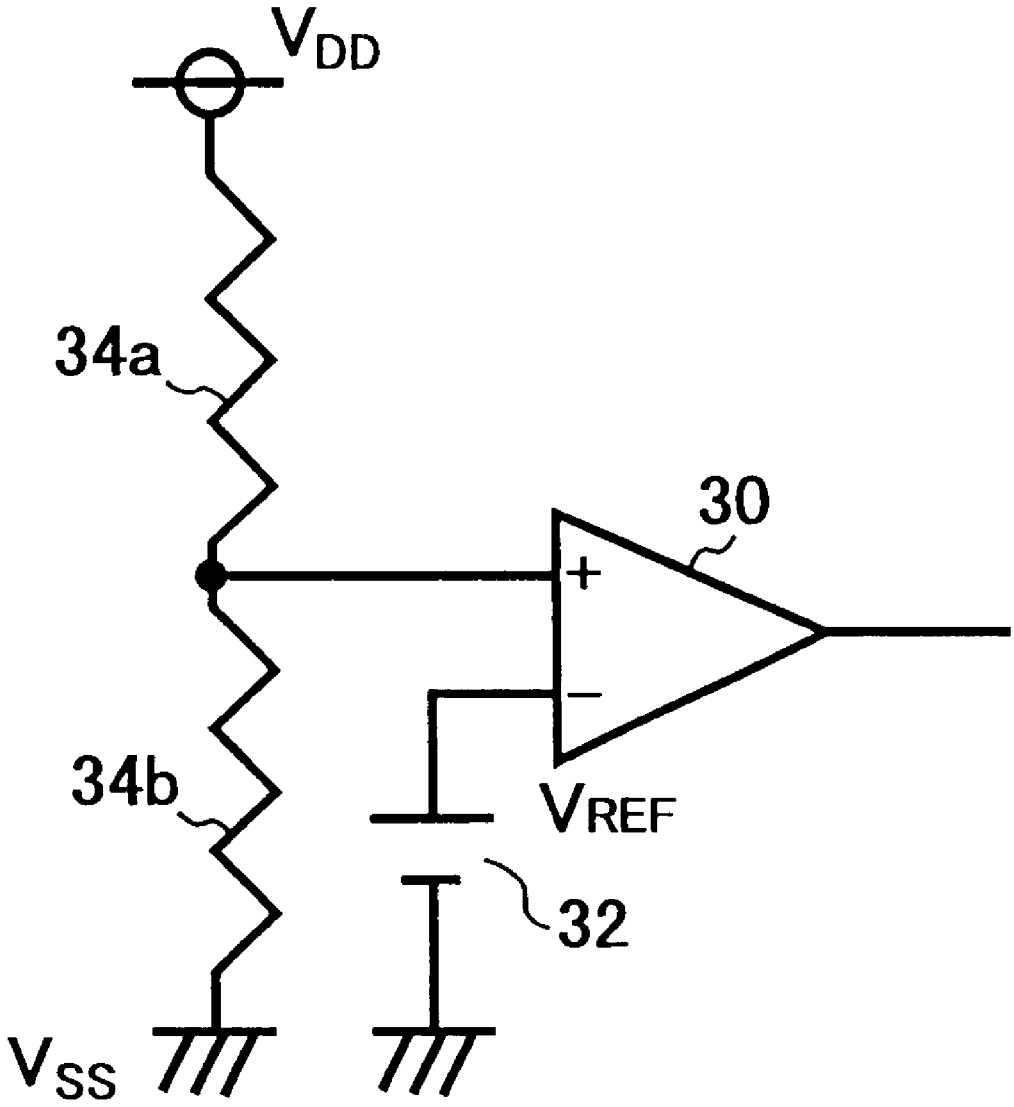
FIG. 15 is an electrical schematic diagram illustrating the principal portion of the detection circuit incorporated into a power supply according to another embodiment disclosed herein.

FIG. 15 is an electrical schematic diagram illustrating the principal portion of the detection circuit incorporated into the power supply according to another embodiment disclosed herein.

Referring to FIG. 15, the detection circuit includes at least a comparator 30, a voltage reference generation circuit 32 and dividing resistors 34*a* and 34*b*.

The voltage reference generation circuit 32 disclosed in anyone of Examples 1 through 3 is connected to the inverting input terminal of the comparator 30 to serve for inputting a voltage reference $V_{REF}$. A voltage output from a battery (not shown) is input to a power terminal $V_{DD}$, divided by dividing resistors 34*a* and 34*b*, then input to the noninverting terminal of the comparator 30. As described above, the voltage reference generation circuit 32 may be selected from those illustrated earlier in FIGS. 1 and 2.

This power supply is designed to operate as follows. When the voltage input from the battery is relatively high and the voltage after divided by the dividing resistors 34*a* and 34*b* is higher than $V_{REF}$, the output from the comparator 30 remains high 'H'; while this output changes to low 'L', when the divided voltage turns lower than $V_{REF}$.

By displaying the thus prepared output by comparator 30 on various apparatuses such as cellular phones, for example, a user may be conveniently notified that the level of the power supply voltage decreased to lower than a predetermined value. Further, according to the detection circuit disclosed herein, the level of, and the change in, the battery voltage may be displayed in a more detailed manner, by providing a plurality of the detection circuits which are designed to have different values of either reference voltages $V_{REF}$ and/or ratios of dividing resistors depending on the way of using.

It is also noted that the present disclosure is not limited to above embodiments. For example, the use of voltage reference generation circuit disclosed herein may also be adaptable to any form of electronic circuits and systems, in which a stabilized voltage reference is required.

In addition to the above Examples 1 through 4, further embodiments will be described in the following Examples 5 through 12.

As described earlier, the output stage of the voltage reference generation circuit of the present embodiment mav consist of n pieces of enhanced-mode MOS transistors, and this circuit is configured to output voltage reference $V_{REF}$ with the magnitude of 1/n of the voltage $V_{IN}$, which is input to the gate of enhanced-mode MOS transistor in the output stage.

Since at least two enhancement-mode MOS transistors among those provided in the output stage are formed so as to have the same channel dopant profile, it becomes feasible for the voltage reference generation circuit disclosed herein to supply reference voltages $V_{REF}$ having improved stability to the conceivable external fluctuations.

Also in the circuit structure disclosed herein, the capability of the voltage reference generation circuit may further be improved, as follows.

First, each of the enhancement-mode MOS transistors in the output stage is formed preferably having the same beta value. The device characteristics of the enhancement-mode MOS transistors therefore vary in the same manner with the possible cause of external fluctuation or instability such as operating temperatures and processing parameters. As a result, the effect from the fluctuation in $V_{REF}$ may further be reduced. Incidentally, it is noted herein that the same beta may be achieved by forming a plurality of the enhancement-mode MOS transistors simultaneously so as to have the same size (W/L), since the beta value is a function of the channel length L, channel width W, dielectric constant $\in$ of gate oxide layer and gate capacitance $C_{OX}$.

Second, the enhancement-mode MOS transistors in the voltage reference output stage may preferably consist of paired transistors formed in the common-centroid structure. With the voltage reference generation circuit incorporating the thus prepared MOS transistors, reference voltages $V_{REF}$ can be supplied with further decreased fluctuation and improved stability.

Third, each of the enhancement-mode MOS transistors may preferably be formed so as to satisfy a following relation $$T_{OX}/(LW)^{1/2} \leqq 1.5\times10^{-3},$$

where L is a channel length, W a channel width and $T_{OX}$ a gate thickness.

In general, the standard deviation C of the pair characteristics (or mismatch) of threshold voltage is generally utilized as a measure for evaluating the degree of 'pairness' in the group of transistors. The value σ is known to be proportional to $T_{OX}/(LW)^{1/2}$ with the proportionality constant 1. By satisfying the relation $T_{OX}/(LW)^{1/2}1.5\times10^{-3}$, the threshold voltage characteristics can be obtained as high as 1σ=1.5 mV. Even after taking into account the 3σ value for the nominal specification of the products, 3σ is obtained to be well within ±5 mV. This 3σ value is considerably smaller than 3σ=±10 mV which is usually accepted to previously known similar products. As a result, more precise values of reference voltages becomes feasible utilizing the voltage reference generation circuit disclosed herein.

In the aforementioned Examples 1 through 4, several embodiments of voltage reference generation circuits and a power circuit incorporating the generation circuit are detailed with the emphasis on the channel profile of MOS transistors. In the following Examples 5 through 12, further embodiments will be described with the emphasis on the structure of the generation circuits, which is incorporated into a power supply. As is described herein below, the power supply includes a detection circuit configured to compare a supplied voltage to a reference voltage as described earlier.

EXAMPLE 5

Figure 16:
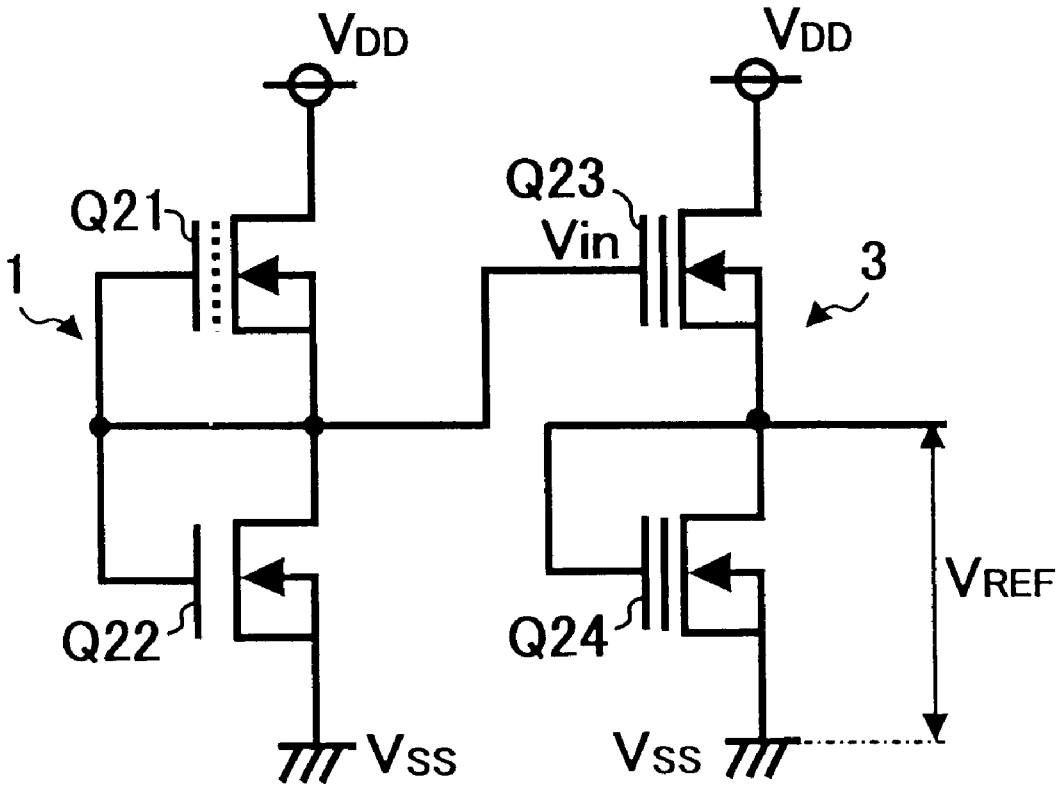
FIG. 16 is an electrical schematic diagram illustrating the principal portion of a voltage reference generation circuit incorporating a plurality of MOS transistors according to another embodiment disclosed herein.

FIG. 16 is an electrical schematic diagram illustrating the principal portion of a voltage reference generation circuit incorporating a plurality of MOS transistors according to a further embodiment disclosed herein.

Referring to FIG. 16, the voltage reference generation circuit includes at least a depletion-mode MOS transistor Q21, an enhancement-mode MOS transistor Q22, and enhancement-mode MOS transistors Q23 and Q24, each having a lower threshold voltage than that of the MOS transistor Q22. The enhancement-mode MOS transistors Q23 and Q24 have the same channel profile, size and beta value. In addition, these transistors Q21, Q22, Q23 and Q24 are all of the N-channel type.

The voltage reference generation stage 1 of the circuit of FIG. 16 consists of MOS transistors Q21 and Q22, and has a circuit construction similar to that previously known. In the embodiment disclosed herein, the output $V_{IN}$ from this generation stage 1 is so designed as to input to the following output stage 3 which consists of transistors Q23 and Q24.

At the output stage 3, the drain of MOS transistor Q23 is connected to a power source $V_{DD}$, the source of MOS transistor Q23 and the drain of MOS transistor Q24 are interconnected, and the source of MOS transistor Q24 is connected to GND. MOS transistors Q23 and Q24 are therefore connected in series, and the junction thereof serves as an output terminal.

In addition, the gate of the transistor Q23 is connected to the output from the voltage reference generation stage 1. Further, the gate and drain of MOS transistor Q24 is interconnected.

Figure 17:
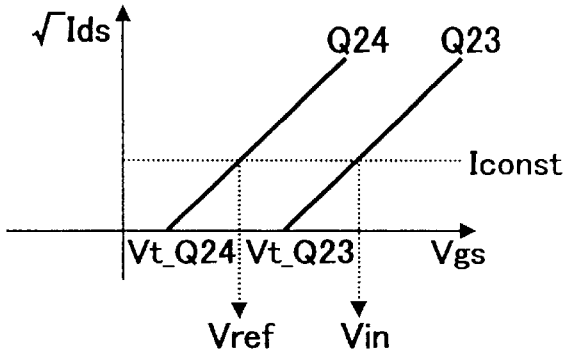
FIG. 17 includes graphical plots of $(I_{ds})^{1/2}$ as a function of $V_{gs}$ for the MOS transistors incorporated into the output stage of the voltage reference generation circuit of FIG. 16.

FIG. 17 includes graphical plots of $(I_{ds})^{1/2}$ as a function of $V_{gs}$ for the MOS transistors Q23 and Q24 at a saturated drain voltage, where $I_{ds}$ is the drain current and $V_{gs}$ is the voltage between gate and source. The conductance factor K is assumed same for respective MOS transistors.

The transistors Q23 and Q24 have the same channel profile and size, as noted earlier. In addition, these two transistors have the same beta, or the slope of the $(I_{ds})^{1/2}$ versus $V_{gs}$ plot, as shown in FIG. 17. The $V_{REF}$ value is therefore obtained as ½ of the $V_{IN}$ value. Also shown in FIG. 17 are $V_{t_}$Q23 to be the threshold voltage of MOS transistor Q23 added by $V_{ref}$, and $V_{t_}$Q24 to be the threshold voltage of transistor Q24.

Figure 18:
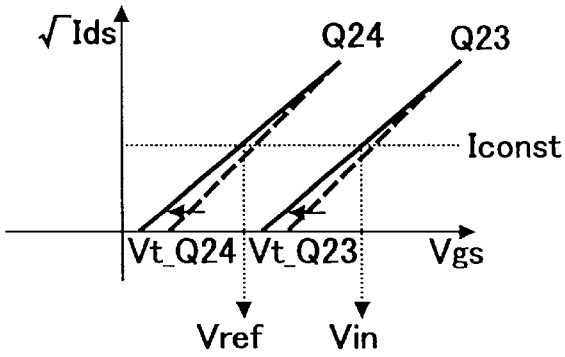
FIG. 18 includes graphical plots of $(I_{ds})^{1/2}$ as a function of $V_{gs}$ at an elevated temperature for the MOS transistors incorporated into output stage of the voltage reference generation circuit of FIG. 16.

FIG. 18 includes a further graphical plots of $(I_{ds})^{1/2}$ versus $V_{gs}$ for the MOS transistors Q23 and Q24 at an increased temperature with the saturated drain voltage (solid straight lines). Two dashed straight lines are also included in FIG. 18 to show the plots prior to the temperature increase (i.e., the graphical plots of FIG. 17).

Although the transistors Q23 and Q24 each have a lower threshold voltage and a smaller beta (or slope of the plot) as shown in FIG. 18, both threshold voltage and beta change in the same manner for both transistors, since the transistors Q23 and Q24 have the same channel profile and size.

As a result, it is found that the difference in $V_{gs}$ remains the same as that before the change (the dashed straight lines of FIG. 18) and that the $V_{REF}$ value is still obtained as ½ of $V_{IN}$.

Figure 19:
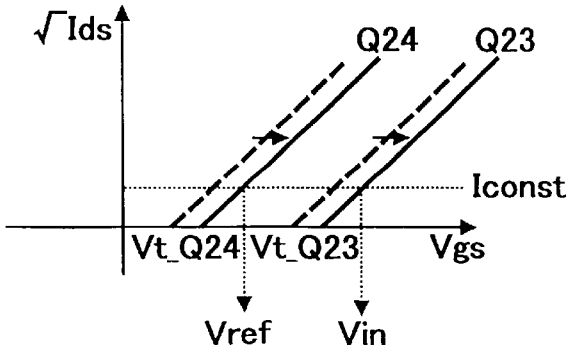
FIG. 19 includes graphical plots of $(I_{ds})^{1/2}$ as a function of $V_{gs}$, affected by the dispersion in threshold values, for the MOS transistors incorporated into output stage of the voltage reference generation circuit of FIG. 16.

FIG. 19 includes a further graphical plots of $(I_{ds})^{1/2}$ versus $V_{gs}$ for the MOS transistors Q23 and Q24 at the saturated drain voltage with a larger dispersion in the threshold voltage (solid straight lines). Two dashed straight lines are also included in FIG. 19 to show the plots without the dispersion.

Since the transistors Q23 and Q24 have the same size and are positioned close to each other, the threshold voltage changes in the same manner in both transistors. Although the value $I_{constant}$ decreases with increasing threshold voltage in this case, the difference in $V_{gs}$ remains the same as prior to the change (the dashed straight lines of FIG. 19) and the $V_{REF}$ value is still obtained as ½ of $V_{IN}$.

With the present generation circuit incorporating MOS transistors Q23 and Q24 each having the same channel profile and size, as described above, it becomes therefore feasible to supply reference voltages with improved stability to the fluctuation in operating temperatures and/or processing parameters.

EXAMPLE 6

Figure 20:
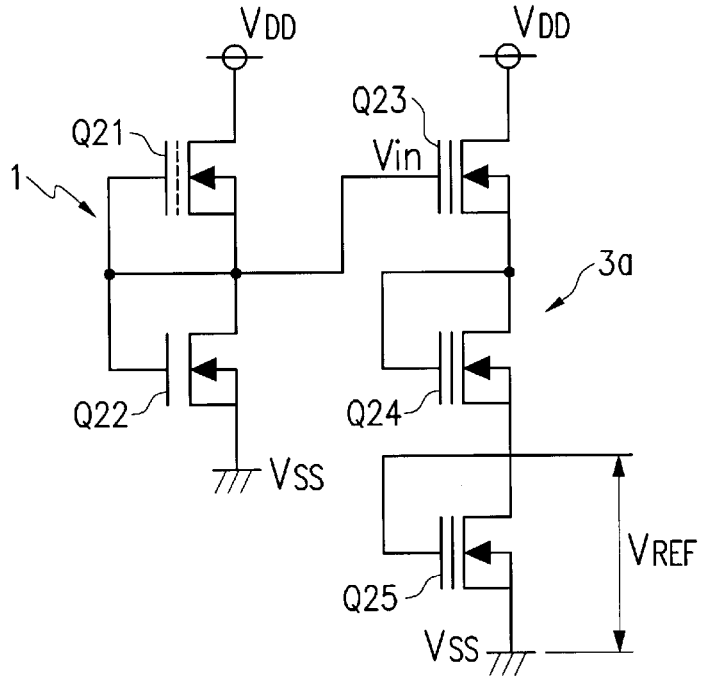
FIG. 20 is an electrical schematic diagram illustrating the principal portion of a voltage reference generation circuit incorporating a plurality of MOS transistors according to another embodiment disclosed herein.

FIG. 20 is an electrical schematic diagram illustrating the principal portion of a voltage reference generation circuit incorporating a plurality of MOS transistors according to another embodiment disclosed herein.

In addition to the MOS transistors Q21 through Q24, which are the same as those in Example 5 (FIG. 16), an enhancement-mode MOS transistor Q25 is additionally included, which has the same channel profile, size and beta value as those of transistors Q23 and Q24.

The source of MOS transistors Q24 is connected to the drain of the transistor Q25. In addition, the source of the transistor Q25 is connected to GND. The MOS transistors Q23, Q24 and Q25 are therefore connected in series, and the drain and gate of MOS transistors Q25 are interconnected. The junction of the transistors Q24 and Q25 serves as an output terminal. The output stage 3*a* of the generation circuit of the present embodiment therefore consists of the MOS transistors Q23, Q24 and Q25.

With the thus formed voltage reference generation circuit further incorporating the MOS transistor Q25 in addition to Q23 and Q24, having the same size as that of the Q23 and Q24 transistors, the $V_{REF}$ value is obtained as ⅓ of $V_{IN}$. It is noted that this value is smaller than that obtained earlier in Example 5, which may offer additional, practical advantages.

In addition, both threshold voltage and beta vary in the same manner in the transistors Q23, Q24 and Q25 with the possible cause of external fluctuation or instability such as temperature and processing parameters, as described also in Example 5.

As a result, it becomes feasible for the voltage reference generation circuit disclosed herein to supply relatively small reference voltages with improved stability to the possible external fluctuations.

EXAMPLE 7

Figure 21:
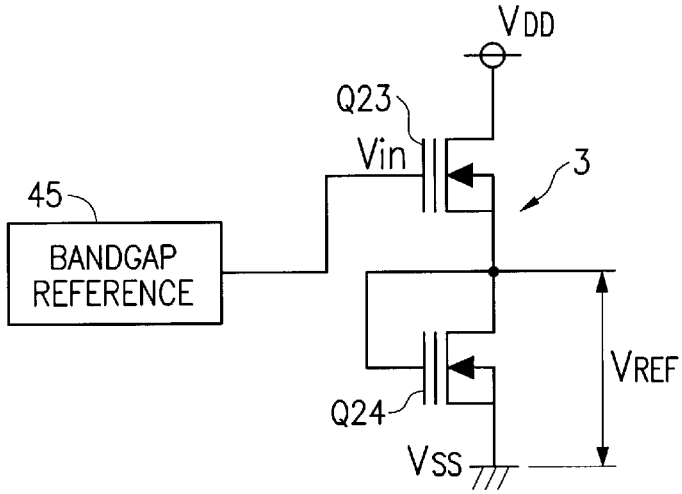
FIG. 21 is an electrical schematic diagram illustrating the principal portion of a voltage reference generation circuit incorporating the bandgap reference as the voltage reference generation stage according to another embodiment disclosed herein.

FIG. 21 is an electrical schematic diagram illustrating the principal portion of a voltage reference generation circuit according to another embodiment disclosed herein.

While the MOS transistors Q23 and Q24, and the output stage 3 of the generation circuit constituted thereof are the same as those of Example 5, the output terminal of a bandgap reference 45 is connected to the gate of the MOS transistor Q23. The bandgap reference 45 herein serves therefore as a voltage reference generation stage.

Since the $V_{IN}$ value itself from the bandgap reference is considerably stable to temperature changes, low reference voltages $V_{ref}$ can therefore be obtained with further improved stability utilizing the voltage reference generation circuit disclosed herein.

EXAMPLE 8

Although the MOS transistors Q23, Q24 and Q25 of Examples 5 through 7 are formed to have the same channel profile and size one another, they may still result in minute fluctuations in threshold voltage and beta value. In order to alleviate the fluctuations and to thereby effect higher uniformity in transistor characteristics, these transistors may be fabricated to be paired in the common-centroid arrangement.

Figure 22:
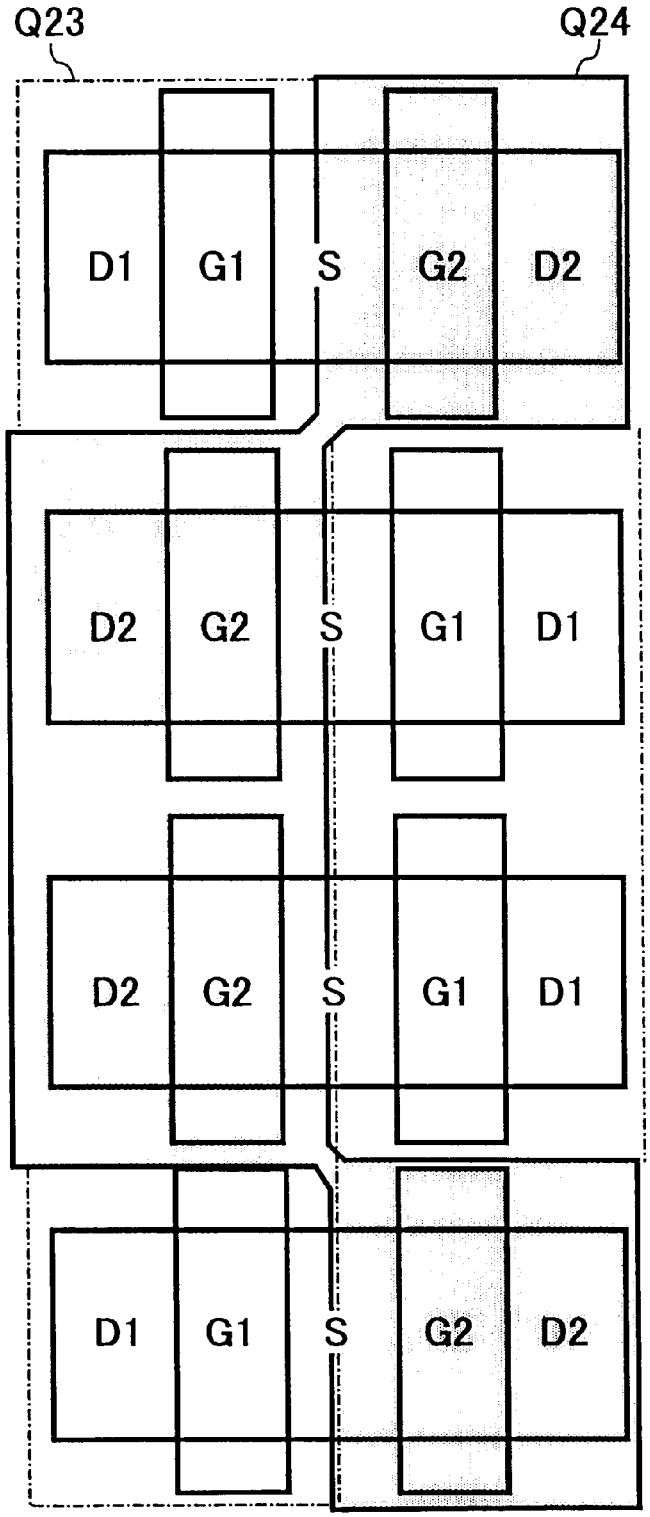
FIG. 22 is a top plan view illustrating two MOS transistors incorporated into the output stage of the voltage reference generation circuit of FIG. 16, which are formed in the common-centroid arrangement.

FIG. 22 is a top view illustrating two MOS transistors corresponding to the transistors Q23 and Q24 of Example 5 (FIG. 16), which formed in the common-centroid arrangement.

In this illustration, the MOS transistor Q23 is formed of four transistors each consisting of gate G1, drain D1, and source S. Similarly, the transistor Q24 is formed of another four transistors each consisting of a gate G2, drain D2, and source S. With the voltage reference generation circuit incorporating the thus prepared MOS transistors, reference voltages can be supplied with further decreased fluctuation and improved stability.

EXAMPLE 9

A power supply is fabricated incorporating any one of voltage reference generation circuits disclosed in Examples 5, 6 and 7, as illustrated in FIGS. 16, 20 and 21, respectively.

The power supply is designed in a similar manner to Example 4 (FIG. 15) primarily for use in hand-held apparatuses such as cellular phones, for example, and includes a detection circuit. This detection circuit is configured to compare a supplied voltage $V_{DD}$ to a reference voltage $V_{REF}$ so that either increase or decrease is detected in comparison with the reference voltage.

As described earlier, FIG. 15 is an electrical schematic diagram illustrating the principal portion of the detection circuit incorporated into the power supply disclosed herein. The present detection circuit is composed in a similar manner to that of Example 4.

Namely, referring to FIG. 15, the detection circuit includes at least a comparator 30, a voltage reference generation circuit 32 and dividing resistors 34*a* and 34*b*. The voltage reference generation circuit 32 disclosed in any of Examples 11, 15 and 16 is connected to an inverting input terminal of the comparator 30 to serve for inputting a voltage reference $V_{REF}$. A voltage output from a battery (not shown), as another voltage source, is input to a power terminal $V_{DD}$, divided by dividing resistors 34*a* and 34*b*, then input to a noninverting terminal of the comparator 30. As described above, the voltage reference generation circuit 32 may be selected from those illustrated in FIGS. 16, 20 and 21.

This power supply is designed to operate in a similar manner to that of Example 4. Namely, when the voltage input from the battery is relatively high and the voltage after divided by the dividing resistors 34*a* and 34*b* is higher than $V_{REF}$, the output from the comparator 30 remains high 'H'; while this output changes to low 'L', when the divided voltage is lower than $V_{REF}$.

By displaying the thus prepared output by comparator 30 on various apparatuses such as cellular phones, for example, a user may be conveniently notified that the level of the power supply voltage decreased to lower than a predetermined value.

A higher stability of supplied voltage is often preferable in the use such as the above noted cellular phones. The generation circuit disclosed herein is therefore advantageous over previously known similar circuits.

In addition, according to the detection circuit disclosed herein, the level of; and the change in, the battery voltage may be displayed in more detailed manner by providing a plurality of the detection circuits which are designed to have different values of either reference voltages $V_{REF}$ and/or the ratio of dividing resistors depending on the way of using.

EXAMPLE 10

Figure 23:
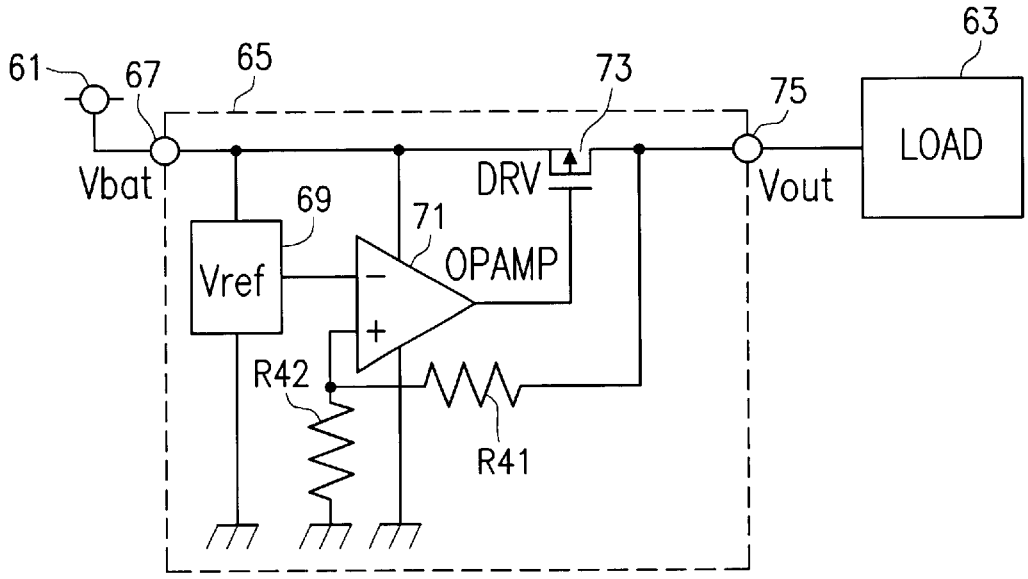
FIG. 23 includes a circuit diagram illustrating a constant voltage source incorporating the voltage reference generation circuit disclosed herein.

A constant voltage source is fabricated as illustrated in FIG. 23, incorporating the voltage reference generation circuits disclosed in Examples 5, 6 and 7.

Referring to FIG. 23, the constant voltage source 65 is configured to supply a stabilized power from a power source 61 to a load 63. The voltage source 65 includes at least an input terminal ($V_{bat}$) 67, to which the power source 61 is connected; a voltage reference generation circuit 69, an operator amplifier (OPAMP) 71, an output transistor (DRV) 73 consisting of a P-channel MOS transistor, voltage dividing resistors R41 and R42 and an output terminal ($V_{out}$).

The operator amplifier 71 is provided with an output terminal connected to the gate of the output transistor 73, an inverting input terminal to be input with $V_{ref}$ from the voltage reference generation circuit 69 and a noninverting input terminal to be input with an output voltage Vour divided by dividing resistors R41 and R42. With the thus prepared operator amplifier circuit, the above voltage $V_{out}$ divided by the dividing resistors can be controlled to be equal to the reference voltage $V_{ref}$.

It becomes therefore feasible to supply stable output voltages based on the stable input reference voltages $V_{ref}$ by utilizing the constant voltage source 65 incorporating the voltage reference generation circuit 69 disclosed herein.

In addition, it may be noted that the present disclosure is not limited to above embodiments. For example, the use of voltage reference generation circuit disclosed herein may also be adaptable to any form of electronic circuits and systems, in which a stabilized voltage reference is required.

EXAMPLE 11

Figure 24:
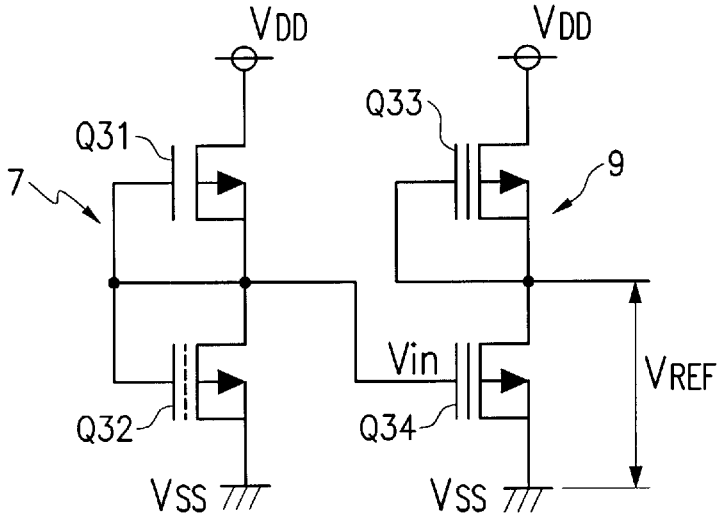
FIG. 24 is an electrical schematic diagram illustrating the principal portion of a voltage reference generation circuit incorporating a plurality of P-channel MOS transistors according to another embodiment disclosed herein.

FIG. 24 is an electrical schematic diagram illustrating the principal portion of a voltage reference generation circuit incorporating a plurality of MOS transistors according to another embodiment disclosed herein.

The voltage reference generation circuit has a similar structure to that of Example 5 with the exception that the former consists of P-channel type MOS transistors in place of N-channel MOS transistors in the latter.

Namely, referring to FIG. 24, the voltage reference generation circuit includes at least an enhancement-mode MOS transistor Q31, a depletion-mode MOS transistor Q32, and enhancement-mode MOS transistors Q33 and Q34, each having a lower threshold voltage than that of the MOS transistor Q31. The enhancement-mode MOS transistors Q33 and Q34 have the same channel profile and size. In addition, these transistors Q31, Q32, Q33 and Q34 are all of the P-channel type, as indicated above.

At the voltage reference generation stage 7 of the circuit of FIG. 24, the source of MOS transistor Q31 is connected to a power source $V_{DD}$, the drain of MOS transistor Q31 and the source of MOS transistor Q32 are interconnected, the drain of the transistor Q32 is connected to GND, and MOS transistors Q31 and Q32 are therefore connected in series.

In addition, the gate and drain of MOS transistor Q31, and the gate and source of MOS transistor Q32 are respectively interconnected. Further, the junction of the MOS transistors Q31 and Q32 serves as an output terminal leading to the following output stage.

The output from thus formed voltage reference generation stage 7 is subsequently input to the voltage reference output stage 9 composed of MOS transistors Q33 and Q34.

At the output stage 9, the source of MOS transistor Q33 is connected to a power source VDD, the drain of MOS transistor Q33 and the source of MOS transistor Q34 are interconnected, and the drain of the transistor Q34 is connected to GND. MOS transistors Q33 and Q34 are therefore connected in series.

In addition, the gate of the transistor Q34 is connected to the output of the voltage reference generation stage 7, and the gate and the drain of the MOS transistor Q33 is interconnected. Further, the junction of the MOS transistors Q33 and Q34 serves as an output terminal.

In the present embodiment, the voltage reference $V_{ref}$ is related to $V_{in}$ by the relation $$V_{ref}=(V_{DD}+V_{in})/2.$$

Since MOS transistors Q33 and Q34 each have the same dopant profile and size also the present embodiment, it becomes feasible to output reference voltages from the output terminal of voltage reference output stage 9 with less dispersion against the fluctuation in temperature and/or processing parameters.

It is apparent from the above description including the examples, the voltage reference generation circuit and the power source incorporating such generation circuit disclosed herein are advantageous over previously known similar generation circuits and power sources.

Among several advantage, since the $V_{REF}$ value is obtained as the difference between threshold values, the dispersion of $V_{REF}$ is relatively unaffected by the fluctuation of source current, which is caused by the dispersion of the threshold voltage of the depletion-mode MOS transistor, the dispersion of $V_{REF}$, and accordingly the dependency of $V_{REF}$ value on temperature are relatively small. In addition, since two enhancement-mode MOS transistors in the output stage are formed so as to have the same channel dopant profile, it becomes feasible for the voltage reference generation circuit to supply reference voltages $V_{REF}$ having improved stability to external fluctuations.

In addition, each of the enhancement-mode MOS transistors is provided with a floating gate having a different threshold voltage depending on, the coupling coefficient between the floating gate and a gate, the amount of charge input to the floating gate, the kind of dielectric material included in the gate, or the thickness of a gate oxide layer. This is suitably utilized to supply reference voltages with improved stability to the fluctuations in operating temperatures or processing parameters.

Additional modifications and variations of the present invention are possible in light of the above teachings. It is therefore to be understood that within the scope of the appended claims, the invention may be practiced other than as specifically described herein.

This document claims priority and contains subject matter related to Japanese Patent Applications Nos. 2000-189343 and 2000-279070, filed with the Japanese Patent Office on Jun. 23, 2000 and Sep. 14, 2000, respectively, the entire contents of which are hereby incorporated by reference.

What is claimed as new and desired to be secured by Letters Patent of the United States is:

1. A voltage reference generation circuit comprising:

a depletion-mode MOS transistor having a gate and a drain interconnected to serve as a constant current source;

at least two enhancement-mode MOS transistors connected in series to said depletion-mode MOS transistor and operating at a saturated drain voltage by the constant current supplied by said depletion-mode MOS transistor;

a first output terminal comprising a first junction of said at least two enhancement-mode MOS transistors; and a second output terminal comprising a second junction of one of said at least two enhancement-mode MOS transistors and said depletion-mode MOS transistor;

wherein said at least two enhancement-mode MOS transistors have a same channel dopant profile and different threshold voltages.

2. The voltage reference generation circuit according to claim 1, wherein said at least two enhancement-mode MOS transistors include two MOS transistors having interconnected gates and a junction of said two enhancement-mode MOS transistors serves as said first output terminal.

3. The voltage reference generation circuit according to claim 1, wherein a gate of each of said enhancement-mode MOS transistors are interconnected.

4. The voltage reference generation circuit according to claim 1, wherein each of said enhancement-mode MOS transistors is provided with a floating gate to have a different threshold voltage depending on a coupling coefficient between said floating gate and a control gate.

5. The voltage reference generation circuit according to claim 1, wherein each of said enhancement-mode MOS transistors is provided with a floating gate to have a different threshold voltage depending on an amount of charge input to said floating gate.

6. The voltage reference generation circuit according to claim 1, wherein each of said enhancement-mode MOS transistors includes a floating gate and has a different threshold voltage depending on a kind of dielectric material included in said floating gate.

7. The voltage reference generation circuit according to claim 1, wherein each of said enhancement-mode MOS transistors has a floating gate and a different threshold voltage depending on a thickness of a gate oxide layer included in said floating gate.

8. A power source comprising:

a voltage reference generation circuit, said voltage reference generation circuit comprising, a depletion-mode MOS transistor having a gate and a drain configured to serve as a constant current source;

at least two enhancement-mode MOS transistors connected in series to said depletion-mode MOS transistor and operating at a saturated drain voltage by the constant current supplied by said depletion-mode MOS transistor;

a first output terminal comprising a first junction of said at least two enhancement-mode MOS transistors; and a second output terminal comprising a second junction of one of said at least two enhancement-mode MOS transistors and said depletion-mode MOS transistor;

wherein said at least two enhancement-mode MOS transistors have a same channel dopant profile and different threshold voltages; and a detection circuit configured to compare a voltage supplied thereto to a reference voltage between said first and second output terminals of said voltage reference generation circuit.

9. A voltage reference generation circuit comprising:

a depletion-mode MOS transistor means having a gate and a drain interconnected to serve as a constant current source;

at least two enhancement-mode MOS transistor means connected in series to said depletion-mode MOS transistor and operating at a saturated drain voltage by the constant current supplied by said depletion-mode MOS transistor;

a first output terminal comprising a junction of said at least two enhancement-mode MOS transistor means; and a second output terminal comprising a junction of said depletion-mode MOS transistor means and said at least two enhancement-mode MOS transistor means;

wherein said at least two enhancement-mode MOS transistor means have a same channel dopant profile and different threshold voltages.

10. The voltage reference generation circuit according to claim 9, wherein said at least two enhancement-mode MOS transistor means include two MOS transistor means having interconnected gates, and a junction of said two MOS transistor means serves as said first output terminal.

11. The voltage reference generation circuit according to claim 9, wherein a gate of each of said enhancement-mode MOS transistor means are interconnected.

12. The voltage reference generation circuit according to claim 9, wherein each of said enhancement-mode MOS transistor means is provided with a floating gate to have a different threshold voltage depending on a coupling coefficient between said floating gate and a control gate.

13. The voltage reference generation circuit according to claim 9, wherein each of said enhancement-mode MOS transistor means is provided with a floating gate to have a different threshold voltage depending on an amount of charge input to said floating gate.

14. The voltage reference generation circuit according to claim 9, wherein each of said enhancement-mode MOS transistor means includes a floating gate and has a different threshold voltage depending on a kind of dielectric material included in said floating gate.

15. The voltage reference generation circuit according to claim 9, wherein each of said enhancement-mode MOS transistor means includes a floating gate and a different threshold voltage depending on a thickness of a gate oxide layer included in said floating gate.

16. A power source comprising:

voltage reference generation circuit means, said voltage reference generation circuit means comprising, a depletion-mode MOS transistor having a gate and a drain interconnected to serve as a constant current source;

at least two enhancement-mode MOS transistors connected in series to said depletion-mode MOS transistor and operating at a saturated drain voltage by the constant current supplied by said depletion-mode MOS transistor;

a first output terminal comprising a junction of said at least two enhancement-mode MOS transistors; and a second output terminal comprising a junction of said depletion-mode MOS transistor and one of said at least two enhancement-mode MOS transistors;

wherein said at least two enhancement-mode MOS transistors having a same channel dopant profile and a different threshold voltage; and detection circuit means for comparing a voltage supplied thereto to a reference voltage between said first and second output terminals of said voltage reference generation circuit means.

* * * * *